United States Patent [19]

Boulet

[11] 3,976,018

[45] Aug. 24, 1976

[54] DRYER SYSTEM

[76] Inventor: William Paul Boulet, 4945 St. Roch Ave., New Orleans, La. 70122

[22] Filed: Feb. 14, 1975

[21] Appl. No.: 549,945

[52] U.S. Cl. ..... 110/10; 110/15; 122/2; 34/173

[51] Int. Cl.[2] ..... F23G 5/04

[58] Field of Search ..... 110/8 R, 8 P, 10, 15; 122/2; 34/173

[56] References Cited

UNITED STATES PATENTS

| | | | |
|---|---|---|---|
| 1,817,228 | 8/1931 | Bliss | 110/8 |
| 1,933,255 | 10/1933 | Goodell | 110/8 |
| 2,033,685 | 3/1936 | Coutant | 110/15 |
| 2,134,229 | 10/1938 | Lipscomb | 34/173 |
| 2,213,668, | 9/1940 | Dundas et al. | 110/15 |
| 3,871,111 | 3/1975 | Porr | 34/173 |

*Primary Examiner*—Kenneth W. Sprague
*Attorney, Agent, or Firm*—Pugh & Keaty

[57] ABSTRACT

A fuel dryer system for waste fuel boilers, such as for example those in the sugar cane processing industry where bagasse is used as a primary fuel, in which the dryer comprises an assembled, enclosed, vertical dryer structure of basically cylindrical shape through which hot drying gases flow with a conical materials collecting hopper and bottom discharge, having alternating conical-shaped rotating and fixed materials trays over which the materials (e.g.bagasse) to be dried move in a net direction from top to bottom (note FIG. 1). Adjustable wipers are provided with the conical materials trays, with access portholes at each tray level. In the sugar cane boiler system the stack gases from the boiler are used for the hot drying gases note (FIG. 5).

10 Claims, 5 Drawing Figures

DRYER SYSTEM

BACKGROUND OF THE INVENTION

1. Field of Invention

The present invention is directed to a dryer system and dryer structure to pre-dry for example "wet" fuels, such as for example bagasse, prior to it being used as a combustible source of heat energy in for example a waste fuel boiler in the sugar cane processing industry, the preferred embodiment using the boiler stack gases as the drying medium in a vertical dryer utilizing uniform, evenly distributed, non-vortex flow of the drying gases and the "wet" fuel to be dried.

2. Prior Art

It is old broadly to pre-dry fuels usually with a mechanical dryer. A typical fuel dryer structure in the prior art of fuel dryers generally comprises a horizontal drum dryer which is gas or oil fired and in which the whole dryer body or drum rotates.

The present invention, it is believed, has especially advantageous application to the field of waste fuel boilers such as are found in the sugar cane processing industry wherein bagasse, the residue of sugar cane, is used as a primary source of fuel.

A 1948 article entitled "Utilizing Bagasse as Fuel" discussed the use of bagasse as a fuel. The article pointed out that the low efficiency in bagasse boiler operation is mainly the result of the large amount of water vapor present in the combustion space. The loss factor is 20% to 25% of the total boiler energy. About two-thirds of this effect derives from the moisture content of the bagasse, and one-third from the products of combustion.

Partial prior art remedies have included preheating of combustion air, feedwater heating, revamping of combustion arrangements and enlarging furnace volume. Results range from good to marginal. When designed into the most modern bagasse boilers, the combination of these features might give a boiler the capability of running on bagasse alone. Even so, the capacity of such a boiler is reduced when running on bagasse alone, primarily because the furnace is doubling as a dryer.

From an engineering standpoint this amounts to treating the symptoms while ignoring the root cause of the malaise. Engineering studies of bagasse drying date back more than half a century. But, the increased capacity and efficiency, and the cleaner burning of partially dried bagasse were apparently outweighed by the availability of cheap supplementary fuels (gas, oil), and the former sufficiency of steam generated.

Recently the sugar mills have had to face a succession of interacting impacts:

1. The need for more boiler output, to supply the increased energy needs within the mill;
2. The mandatory cleanup of stack effluents; and
3. The increasing unavailability and the escalating cost of natural gas and fuel oil.

The author's conclusion in the above referenced 1948 article, re the economic feasibility of drying bagasse fuel, was prophetic.

GENERAL DISCUSSION OF THE PRESENT INVENTION

The preferred embodiment of the dryer of the present invention comprises an assembled, enclosed, vertical dryer structure of basically cylindrical shape with a conical materials collecting hopper and bottom discharge, having alternating conical-shaped rotating and fixed materials trays over which the materials to be dried move in a net direction from top to bottom. Various means are used as hereinafter described to give a controlled flow rate to the materials, and to distribute the same in such a way as to resist choking or clogging of the materials, and to create the maximum amount of drying effect. Hot drying gases are moved through the dryer passages as described, drying the materials with which the gases come in contact. The net direction of the hot drying gases depends on the characteristics of the materials being dried, the safety factors involved, and all other desired effects and their related engineering factors. The direction of drying gases flow to be selected is discussed below.

The present invention is believed to create a thorough contact action for the purpose of drying, including forced mixing of solids and the drying gases, an economy of expended energy for the effect produced, a space economy, a variable control over the rate and the degree of drying, an anti-choking and anti-fouling action as regards the flow of the material to be dried, and a wide range of combination of the variable design factors, permitting the present invention to be applied to a broad spectrum of materials and drying gases. The vertical flow orientation, as compared to horizontal (or nearly horizontal) flow dryers of the prior art, lends advantages for some processes and plant layouts where horizontally oriented flow of gases and materials would be less desirable or impractical. The space economy achieved by the present invention, as compared to any previous dryer design of vertical flow orientation, is considered a distinct advantage. The present invention also lends itself to flexible arrangements of the inflow and discharge directions of the drying gases, and this multiple choice of directions is usually of advantage in space and cost economy for a given system design. In processes where the solids to be dried are of a bulky, porous, fibrous nature, a filtering effect within the dryer of the present invention (due to crossflow of gases and solids) removes smaller airborne dusts at each level in the dryer where crossover occurs, thereby reducing the air-polluting tendency which is common to all drying apparatus employing a drying gas stream which is discharged to the atmosphere.

The wet fuel drying system of the present invention in combination with a waste fuel boiler used no additional fuel and increases the boiler's combustion capacity and efficiency whether or not the boiler is also equipped with stokers, air-preheaters, etc. Also the present invention eliminates the boiler's dependency on auxilliary fuels, without a substantial drop in combustion capacity, as is the case with prior art boilers equipped with air preheater systems. For example, in sugar factories, bagasse is used as a primary fuel, but heretofore, a supplemental fuel such as natural gas has usually been necessary to burn the bagasse because of its moisture content and the presence of cane trash and dirt. The present invention eliminates the need to use a supplemental fuel such as the now very scarce natural gas.

Bagasse drying it is believed, is the best available source of boiler efficiency upgrading, and the most promising method of eliminating dependency on natural gas and oil as supplementary fuels.

With skyrocketing fuel costs an established fact, the cost savings should be significant, running into six figures for some mills. If the threat of shutdown from these auxiliary fuels is eliminated, mills will be freed of the fear of economic disaster resulting from political decisions.

In deciding to dry bagasse, mill management can elect to field-store, air-dry, and then reclaim the dried bagasse as fuel a year later. Or, they can employ immediate drying in accordance with the present invention following the final cane crusher discharge, and, after drying, delivering the fuel directly to the furnace, thus eliminating the considerable storage and handling problem. In the latter case, a limited amount of the dried product will be set aside as an emergency supply, and used when the flow of cane within the mill is temporarily stopped. Forced drying offers another advantage, in the close control of the residual moisture content of the dried bagasse, which will be vital to optimum furnace operation.

As to existing fuel boilers, the present invention maximizes performance and profits and minimizes expenses and pollution. As to new or future boilers, the present invention should reduce initial costs 20 to 30 percent by reducing furnace size and simplifying the furnace and stoker designs and greatly reducing the cost, size, and complexity of the air-heat system. Moreover, it is believed that no other fuel dryer system can equal the preformance flexibility and adaptability of the wet fuel dryer of the present invention.

As will be more clear from the detailed description of the preferred embodiment below, among the advantages of the present invention are:

1. Maximum drying effect through evenly distributed, controlled cross flow of hot gases and bagasse, both on the conical surfaces and in the openings in between.
2. Automatic tendency to prevent choking. If overfeed of bagasse chokes dryer, as soon as the feed rate is reduced to normal, the dryer automatically begins to unclog, due to the higher blower backpressure and the action of the wipers.
3. Practically eliminates fire hazard. Concurrent flow directions mixes hottest gases with wettest bagasse at upper end, and vice versa at lower end. Automatic hot gas diverter (dampered gas bypass) can be used to isolate dryer and smother fire if it should ever occur.
4. Bagasse retention time in dryer and final degree of dryness can be regulated over a wide range of fuel types and conditions and boiler combustion condition by using the proper settings of the adjustable speed drive, the adjustable wipers, the gas flow to the dryer, and the selection of the slope angles and spacing of the fixed and rotating materials trays.
5. Rotating shaft and cones are removable from top of dryer without dismantling or disconnecting ducts. Makes easy repair or replacement of wear surfaces.
6. Low power consumption for effect achieved. Power of rotating shaft and cones is low, and nonsurging due to even distribution of materials within dryer. Advantageous aerodynamic flow patterns minimize power consumption of fan forcing gases through dryer.
7. Due to the evenness of distribution of both gases and solids flowing through the dryer body, a positive filtering effect occurs due to the crossflow of solids and gases at each solids dropoff location. Additional separation of solids from the gas stream also occurs at each level where a centrifugal effect occurs due to the gases changing direction. Thus, the gases are automatically subjected to a continuous cleaning effect. This is important where a substantial polluting effluent is typical, as for example, with a boiler burning waste fuel.
8. The use of this design dryer in conjunction with a waste fuel boiler, where the dried fuel is fed to the boiler, will enable increased boiler-furnace combustion rate, boiler efficiency and steam output, and, by virtue of a cleaner burning effect within the furnace, reduce substantially the initial airborne solids and gaseous effluent (per unit of fuel) leaving the boiler.

BRIEF DESCRIPTION OF THE DRAWINGS

For a further understanding of the nature and objects of the present invention, reference should be had to the following detailed description, taken in conjunction with the accompanying drawings, wherein:

FIG. 1 is a side view of the internal structure of the vertical dryer which forms the preferred embodiment of the present invention; while FIGS. 2 and 3 are side views of the external structure of the vertical dryer of FIG. 1, with one view taken from a different perspective of 90° with respect to the other view; while FIG. 4 is a plan view of the gas inlet (outlet) shroud element of the dryer of FIG. 1.

DETAILED DESCRIPTION OF PREFERRED EMBODIMENT

Figures 1, 4:
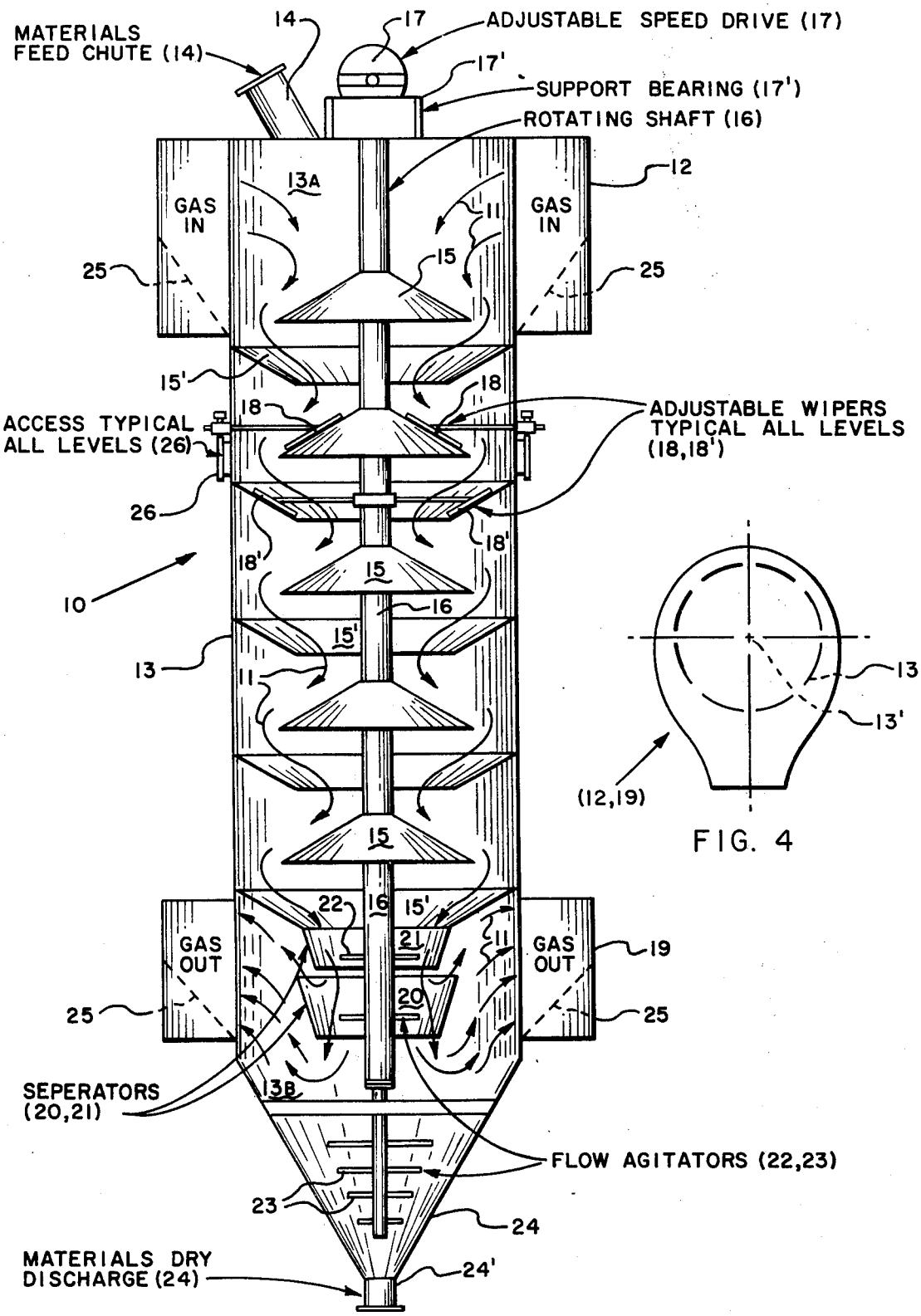

The drawings, particularly FIG. 1, illustrate the operation of the preferred embodiment of the dryer 10 of the present invention when hot drying gases 11 are entering at the upper end 13*a* of the dryer 10. The gases 11 enter from a peripheral inlet shroud 12 encasing much or all of the upper level 13*a* of the dryer, and flow through openings (not specifically illustrated) in the cylindrical periphery of the main body 13 of the dryer 10.

Simultaneously, the materials (not specifically illustrated) to be dried enter the dryer 10 through the "Materials Feed Chute" 14, and drop onto the first of a series of conically shaped aprons 15, which are alternately rotating (15) and fixed (15′). The flow rate of materials entering the dryer 10 is assumed as controlled within desirable limits. The inner conical aprons 15 attach to a "Rotating Shaft" 16, driven by an "Adjustable Speed Drive" 17 mounted on "Support Bearing" 17′.

As the speed of the rotating shaft 16 increases, the tendency of the materials resting on the rotating aprons 15 to slide down the apron will increase, and vice-versa. Hence, a desirable flow velocity of materials on the rotating inner cones 15 is in part determined by this rotational speed.

Further regulation of flow velocity is varied by the action of non-rotating "Adjustable Wipers" 18, which can be shaped, constructed and positioned so as to slow or speed up the flow and agitation of the solids moving down the rotating upper surface of the inner cones 15 attached to the rotating shaft 16. The height of the wipers 18 above the rotating cones is fully adjustable, as well as the angle of position, and, further that the angle is unrestricted relative to the surface of the rotating cones 15 and the solids moving thereon. The wiper "blade" may be made in any shape which might be advantageous to obtain the flow rate and degree of agitation desired, and this shape is meant to include flexible shapes, curved or straight shapes, toothed or perforated shapes, and any combination of materials and shapes which will aid in obtaining the desired effects.

In a similar manner, the flow of materials which fall from the inner rotating cones 15 onto the outer (fixed position) cones 15' is regulated on the fixed outer cones 15' by the combined action of the drying stream of hot gases 11 and the adjustable moving wipers 18' attached to the rotating shaft 16 or to anything attached to the rotating shaft 16. As illustrated, the moving wipers 18' are attached directly to the shaft. These moving wipers 18' are adjustable as to position, angle, configuration and flexibility, as are the fixed wipers 18 described above. The gas stream 11, flowing between the bottom of the rotating cone 15 and the buildup of materials dropped onto the next lower fixed cone 15', combines its velocity, pressure, and turbulence with the action of the rotating wipers 18' to keep the materials on the lower cones 15' moving toward the dropoff point, where the materials fall onto the inner rotating cones 15; this cycling from the inner cone 15 to the outer cone 15' and down to the next inner cone 15 continues until the materials have reached the bottom section **13*b* of the dryer 10.**

The gas flow velocity increases at any level where the buildup of materials on a cone increases. Therefore the force of the gas stream 11 at such higher velocity locations will help move more of the materials while the higher velocity exists. Conversely, at locations where there is less material collected on a given cone, the gas velocity is less, thereby reducing the velocity pressure tending to force the materials down the slope of the cone. Hence the dryer 10 of the present invention has an inherent self-regulating characteristic tending to maintain an even flow and distribution of materials at all levels down to the bottom section of the dryer 10.

The angle of slope of the fixed and rotating conical surfaces 15, 15' is a variable which will differ according to the service of the dryer 10. Factors determining these angles include the materials to be dried, and the volume, temperature and composition of the drying gases 11. The angle of slope of these cones need not be the same, but may be selected according to the design needs at each level. Thus, a very flexible design capability exists by virtue of this angle of slope selection. This flexibility is increased for a given dryer unit if the cones are constructed so as to be removable without damage to the other parts of the dryer. With such removability, the replacement of the conical elements 15, 15' can be economically effected (as compared to the cost of replacing the entire dryer unit), whenever wearing of these conical surfaces requires repair or replacement, or whenever a change of drying and/or wear characteristics is desired for the dryer unit 10. In this latter case, the replacement of cones 15, 15' could be with cones of a different slope, or diameter, or material, or whatever factor would be desired. It is also possible with such a replaceable capability of the cones 15, 15' to vary the vertical spacing of the cones from the original setting. This would allow an additional flexibility of control of the overall drying and flow characteristics for both the gases and the materials.

Lastly, these cones 15, 15' might be modified as to surface configuration. While maintaining the characteristic downslope, the surface of the conical surface could be modified. For example, the change from a simple conical surface to a conical-like surface with varying slope (generated by rotation of other than a straight line about the conical axis) would permit use of all the previously described methods and devices which give flexibility of design and control of flow, while achieving a change in the overall characteristics of the conical-like surface insofar as its tendency to retain or discharge solids at a given level or radial position within the dryer. The flow characteristics of the drying gases 11 would also be affected by such a change in slope configuration. For example, if all the rotating inner cones 15 were made with curved convex downslope, and the fixed outer cones 15' were made with a curved concave downslope, and these curves were proportioned to assist smooth aerodynamic flow of gases, the gases' flow pressure losses would be reduced, as compared to most similarly spaced arrangements using pure conical surfaces with straight-line slopes. The infinite combination of such modified slope profiles substantially increases the latitude for designing dryer characteristics to match the characteristics of the materials to be dried and the drying gases.

In order to provide ready access to the internal workings of the dryer 10, e.g. to the conical trays 15,15' and/or the adjustable wipers 18,18', access portholes 26 are provided at each level. It is noted that, for simplicity purposes, the access portholes 26 and the adjustable wipers 18,18' are not illustrated at every level in the drawings. However, as the legends in the drawings indicate, they should be considered as being provided at every level in the preferred embodiment.

As the materials near the bottom 136 of the dryer 10, the separation of most of the gaseous and solids materials is effected by the steep slope conical separators 20, 21, which may be in any practical number, spacing and depth as is suited to the requirements of separation. These separators 20, 21 use the principle of difference in density to assist the separation of solids from the gases as the gases 11 turn toward the discharge shroud 19 of the dryer 10. The solids of coarser size and greater bulk density will naturally fall to the conical hopper 24, while the gases and finer solids will tend to separate at reducing velocity as they approach the outer discharge shroud 19. The gases 11, with whatever entrained solids have not separated out, will then leave the cylindrical body 13 of the dryer 10 through openings therein (not specifically illustrated), and flow into the discharge shroud 19 external to the dryer cylinder 13.

The shroud area 19 is marked "GAS OUT" in FIG. 1 which illustrates a dryer 10 with a net downflow direction for gases 11. For some applications it might be more desirable to have the hot drying gases 11 flowing upward through the dryer 10, that is to say, against the downflow of the solids being dried. The selection of concurrent (downflow) flow or counterflow (upflow) of drying gases will be determined in each case by the overall design requirements.

In the case of the upflow of gases, however, certain of the characteristics described above for concurrent flow will be altered, such as the augmenting effect of the gas velocity pressure on the downflow of solids will be reversed, and thus tend to counter the solids downflow. The advantages and disadvantages of each gases flow direction will, in each case, determine which is to be chosen for a given application. One important characteristic of the dryer of the present invention is the forced crossflow of solids and gases at each location within the dryer where the solids drop off the bottom of the cones 15, 15' to the next lower cone level. This crossflow aids the drying effect by forcing the gases and solids to intermix, thus improving the contact of the hot gases 11 with the solids. As is obvious from the drawings, particularly FIG. 1, this crossflow occurs regardless of whether the gaseous flow direction is up or down with the dryer 10.

The "Flow Agitators" 22, 23 shown are attachments to the rotating shaft 16 and are placed where needed to prevent choking or bridging of the solids in the bottom segment 13 of the dryer. The dimensions, and configuration will depend on the material being agitated and dried. In general, the agitators 22, 23 will be attachments to the rotating shaft 16, producing a stirring action. The construction may be either rigid or flexible, depending on the design choice for the material being agitated.

The "Materials Dry Discharge" 24' empties the hopper 24 for carryoff to other devices and equipment. The hopper 24, besides conical, could be of any other convenient or appropriate shape.

It should be realized that there will often, but not necessarily always, be a need to provide a continuous, peripheral, inner sloped surface (not phantom lined elements 25) at the vicinity of the bottom of either or both of the shrouds 12, 19 to prevent retention of any of the solids flowing through the dryer 10. The angle of inclination of such sloped surfaces 25 would be such as to assure that the particular solids being dried would not collect at these locations, but would be discharged below the shrouds 12, 19. The sloped surfaces 25 thus described might be either the outer encasing lower portion of the shroud 12, 19, or a built-in surface within the shroud 12, 19 itself. The inclusion of such a sloped surface 25 in either shroud would not necessarily require the use of such a surface in the other shroud.

Figure 2:
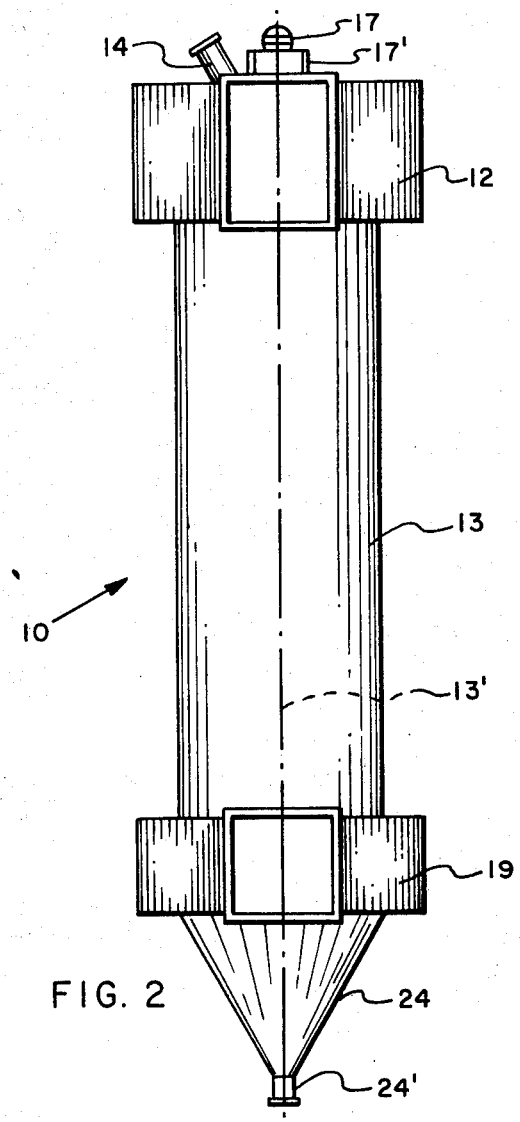
Figure 3:
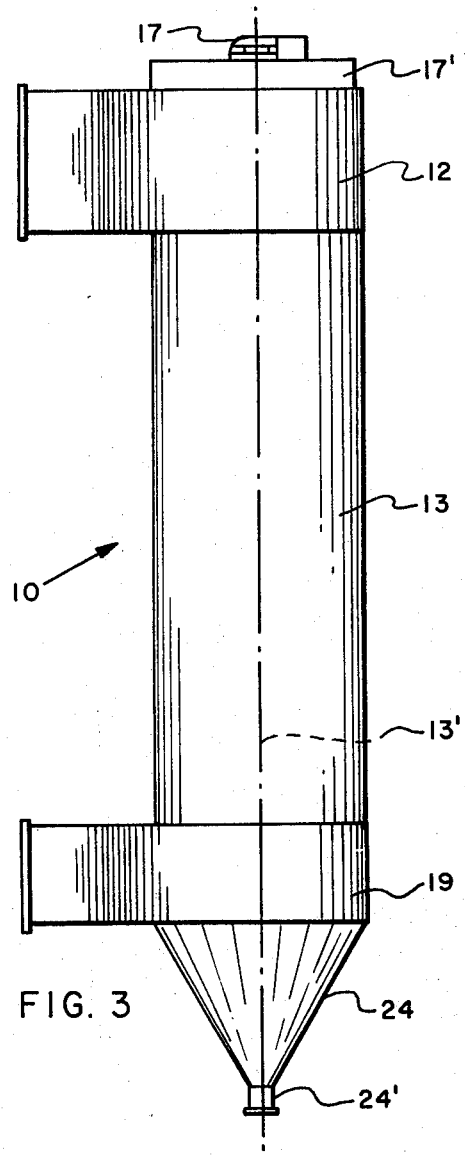

While the inlet and outlet shrouds 12, 19 are conceived in the general, pear-shape, curved form shown in FIG. 4, the shape shown is only general and not definitive, except that the shroud should be symmetrical about the line of flow (viewed from above or below) of the entering or leaving gases 11. This shape is basically meant to feed the system gases in a line toward the body centerline 13' of the dryer cylinder 13. The purpose of this is to assure that there is a balance of gas flow, preventing a vortex pattern within the body of the dryer 10. A vortex pattern would result in gas flow patterns which would not be desirable from the standpoint of achieving the interaction of solids and gases described herein and would contradict the described interaction pattern. As seen in FIGS. 2 and 3, the gas inlet and the gas discharge outlet of the shrouds 12, 19 are positioned at the same angle with respect to the centerline 13'. However, they should be aligned as appropriate as required for each installation and need not be at the same angle.

The motive power for flow of gases is external to the dryer 10 and may be either upstream or downstream of the dryer 10. The usual gas movers for this type of equipment are fans or blowers (not illustrated) which develop a pressure curve of increasing pressure with reducing volume, and vice versa. The above described functions of the gases with respect to developing velocity pressure and/or static pressure at points of restricted passage are based on such a typical pressure-volume characteristic. Depending on whether the fan is forced or induced draft with respect the dryer 10 the means and methods used to feed and empty the dryer of solids will ordinarily be different; the construction of the dryer 10 will also be different from a structural adequacy standpoint. But, these factors are incidental to the present invention, and are therefore not detailed herein. The absence of construction details such as dryer supports, entrance and exit openings (for gases), braces, methods of fastening and assembly, and other matters which are also only incidental to the present invention, are likewise not discussed herein, these details being easily supplied by those skilled in the art to which the present invention pertains.

Figure 5:
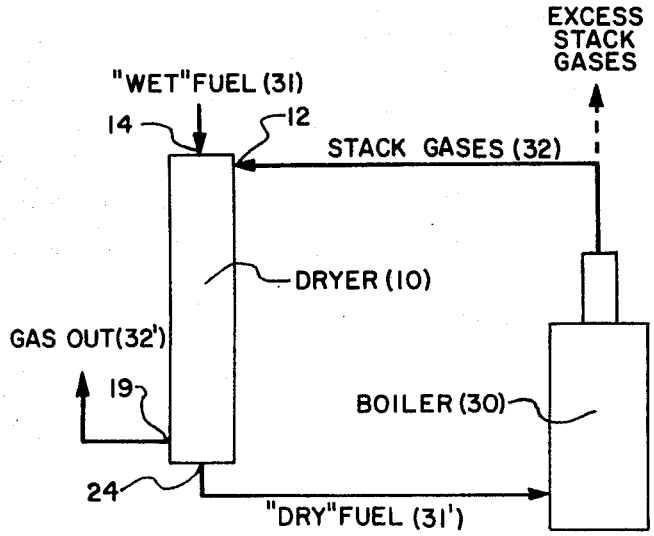
FIG. 5 is block, schematic illustration of the fuel drying system of the present invention utilizing the preferred embodiment of the dryer of the present invention.

As discussed in the "Background" portion hereof, the dryer 10 and the fuel drying system of the present invention has particular application to waste fuel boilers, especially those found in the sugar cane processing industry where bagasse is used as a primary boiler fuel. As generally and schematically illustrated in FIG. 5, the dryer 10 utilizes the stack gases 32 from the boiler 30 itself as the source of heated gases 11 for the drying operation. The "wet" fuel 31, e.g. bagasse, is delivered as the material to be dried to the dryer 10, wherein through the gas/material interaction described above, "dry" fuel 31' is produced and fed to the combustion chamber of the boiler 30. The heating gases 11 from the stack gases 32 introduced at shroud 12 serve as the sole drying agent and upon emerging from the shroud 19 can be vented as "cooled" gases 32' to the atmosphere or further treated or used as a treating agent, as appropriate.

While it is desirable and advantageous to perform the drying action above described without the expenditure of auxiliary fuel, such as oil or natural gas, this should not be construed as limiting the ability of this dryer design to be used, wherever desirable or necessary, with any source of hot drying gases. Thus, the dryer design described might be appropriately and advantageously used to dry any suitable material with any suitable source of hot drying gases. The additional advantages when drying "wet" fuel associated with a waste fuel boiler system, of which this design dryer is an integral part, have already been described in connection with a sugar cane boiler plant. Additionally, other typical examples of waste fuel applications for the principles of the present invention besides sugar cane processing plants are paper mills using wood and bark as a waste fuel, and coffee processing plants using spent coffee grounds as a waste fuel.

The dryer 10 thus uses hot boiler effluent or stack gases 31 as its source of heat, and it requires no other source for its operation. Set out below are projected performance standards within the range of removing 50% to 70% of the bagasse moisture with the use of the present invention. These projected performance standards are a calculated approximation to actual performance, which in each case will, of course, depend on the existing operation conditions of each particular boiler.

BAGASSE DRYER PERFORMANCE
AT 70% AND 50% DRYING EFFECT

| | | |
|---|---|---|
| Moisture removed, % of original | 70% | 50% |
| Assumed initial moisture, % of bagasse weight | 52% | 52% |
| Moisture removed, Lbs./Lb. Wet Fuel | .354 Lb. | .260 Lb. |

-continued
BAGASSE DRYER PERFORMANCE AT 70% AND 50% DRYING EFFECT

| | | |
|---|---|---|
| Dryer inlet temperature, °F | 650° | 614° |
| Dryer outlet temperature, °F | 272° | 325° |
| Temperature drop in dryer, °F | 378° | 289° |
| Increase in net heat available, BTU/Lb. Wet Fuel | 290 BTU | 212 BTU |
| Increase in boiler efficiency (Original = 55%) | +13.9% | +10.2% |
| Increase in boiler efficiency (Original = 50%) | +15.3% | +11.2% |
| Additional boiler hp per 1000 TPD cane flow | +288 HP | +211 HP |

It should be noted that in the above calculations the dryer inlet temperatures shown are based on an assumed present effluent temperature of 550°F, which will increase to the calculated temperature shown. This higher effluent temperature derives from an increased combustion efficiency and a maximum assumed excess air ratio of 1.60 burning the dried bagasse.

In closing it is noted that the drawings and the foregoing detailed description should not be interpreted as defining specific dimensions, or materials of construction, nor should the use of the drawings infer any restriction or limitation on the types of materials which could advantageously be dried in a dryer of the particular design of the preferred embodiment. The dryer of the present invention is intended to apply to any and all combinations of materials and gas streams which are capable of producing the desired drying effect, using the construction and methods for example available from this disclosure. Also, while the drawings illustrate an implied metallic construction, the selection of materials is not limited to this.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A fuel dryer and boiler system comprising:

a. a fuel dryer including
- — an elongated, at least generally vertically disposed hot gas/materials interaction drying chamber;
- — a gas inlet at one end of said chamber and a gas outlet at the other end of said chamber, hot gases being conducted through the length of said chamber from said gas inlet to said gas outlet in at least generally uniform, evenly distributed, non-vortex flow;
- — a solid "wet" fuel material inlet at the upper end of said chamber and a solid "dry" fuel material outlet at the other, lower end of said chamber, said solid fuel material moving down through said chamber from said material inlet to said material outlet at least partially under the influence of gravity, said hot gases and said solid fuel material intermixing together in said chamber, drying said solid fuel material; and
- — lateral projection means mounted within said chamber extending partially across said chamber for causing a positive forced filtering effect of said gases flowing through said material to remove airborne pollutants by causing cross flow of said material and said gases as they move through said chamber, said lateral projection means comprising an inner section and an outer section spaced apart and vertically staggered and horizontally interdigitated with said inner section with the space therebetween both in the horizontal and the vertical directions being at least substantially open, said inner and outer sections causing said gases to change direction laterally producing centrifugal separation effects on the airborne pollutants;

b. a boiler including
- — a combustion chamber;
- — exhausting means for exhausting the hot gases created in said combustion chamber;

c. A gas duct from said exhausting means to said gas inlet connecting the exhausted gases of said boiler serving as said hot gases; and d. fuel conveying means between said fuel materials outlet and said combustion chamber for delivering the "dry" fuel materials to said combustion chamber, said "dry" fuel materials serving as the principal fuel for said boiler.

2. The fuel dryer and boiler system of claim 1 wherein said lateral projecting means comprises at least one set of alternating, downwardly inclined surfaces located in the path of flow of said hot gases and the falling solid fuel materials, one of said inclined surfaces emanating from an internal structure forming said inner section and the other emanating from an external structure forming said outer section.

3. The fuel dryer and boiler system of claim 2 wherein said internal structure rotates with respect to said external structure, said chamber is at least generally cylindrically shaped, said inclined surfaces form conical-like surfaces, said external structure is the main body of said chamber, and said internal structure is a shaft which at least generally coincides with the axis of the cylindrical shape and with the axis of said conical-like surfaces, said conical-like surfaces being formed by surfaces of revolution of a line which produces a downslope surface having its generating axis of revolution at least generally coincident with the axis of rotation of said internal rotating structure and the axis of said cylindrically shaped chamber.

4. The fuel dryer and boiler system of claim 2 wherein there is further included one or more sets of wiper-agitators positioned above said inclined surfaces, said wiper-agitators interacting with the solid fuel material on the said surfaces to produce a flow and distribution control effect on the solid fuel materials, and a mixing effect on said materials with respect to said flowing hot gases, said effects being produced in combination with the rotating action of the said internal rotating structure and conical-like surfaces supporting the solid fuel material, and said effects also being produced in combination with the velocity pressure effect of the flowing gases.

5. The fuel dryer and boiler system of claim 4 wherein the wiper-agitators interacting in the vicinity of said inclined surfaces emanating from said internal structure are supported by said outer section and/or structures attached to said outer section, and the wiper-agitators interacting in the vicinity of said inclined surfaces emanating from said external structure are supported by said inner section and/or structures attached to said inner section.

6. The fuel dryer and boiler system of claim 2 wherein there is a series of alternating, downwardly inclined surfaces located serially in the path of flow of said hot gases and said falling solid materials.

7. The fuel dryer and boiler system of claim 1 wherein at least one of said gas inlet and said gas outlet is in the form of a shroud which is symmetrical about a plane through the centerline of flow of said hot gases in said shroud, and the centerline of said chamber, said symmetrical arrangement causing the gases entering and leaving the chamber to do so in a manner which avoids and opposes the formation of a vortex flow pattern with respect to the centerline axis of said chamber, said symmetrical shroud arrangement serving further to minimize gases flow loss entering and leaving said chamber, and to reduce separation gas velocities in the lower area of said chamber where final separation of solids and gases is affected by this gas velocity.

8. The fuel dryer and boiler system of claim 1 wherein said material is a waste fuel, such as for example "wet" bagasse, said boiler is a waste fuel boiler such as for example a sugar cane processing boiler, said exhausted gases are at least in general the principal source of hot gases for said chamber, and said "dry" materials are the principal fuel for said boiler, diminishing the need for secondary or auxiliary fuels such as for example fuel oil and natural gas, and said fuel dryer diminishing and limiting the pollution emitted from such a boiler to the atmosphere, while also limiting and collecting pollution generated internally in said dryer.

9. The fuel dryer and boiler system of claim 1 wherein said gas outlet is in the form of a shroud located near the bottom of said chamber, and said chamber further includes near its bottom adjacent to said gas outlet, separator means formed of at least one generally conically-shaped structure having a steep slope and circumferential gas passages for assisting in the separating of said gases and said material, and avoiding reentrainment of said material by said gases.

10. The fuel dryer and boiler system of claim 1 wherein said dryer is integrated directly into the hot gases discharge stream of said boiler, permitting full range boiler draft control and operating flexibility of the combination.

* * * * *

UNITED STATES PATENT AND TRADEMARK OFFICE

CERTIFICATE OF CORRECTION

PATENT NO. : 3976018

DATED : August 24, 1976

INVENTOR(S) : William P. Boulet

It is certified that error appears in the above-identified patent and that said Letters Patent are hereby corrected as shown below:

Column "3", line 18, after "existing", insert:

--waste--

IN THE CLAIMS:

Column 11, line 2, after "of", insert:

--sets of--

Signed and Sealed this

Sixteenth Day of November 1976

[SEAL]

*Attest:*

RUTH C. MASON
*Attesting Officer*

C. MARSHALL DANN
*Commissioner of Patents and Trademarks*